US005659156A

United States Patent [19]

Mauney et al.

[11] Patent Number: 5,659,156

[45] Date of Patent: Aug. 19, 1997

[54] EARMOLDS FOR TWO-WAY COMMUNICATIONS DEVICES

[75] Inventors: Daniel W. Mauney, La Jolla; Robert W. MacKay, Carlsbad, both of Calif.

[73] Assignee: JABRA Corporation, San Diego, Calif.

[21] Appl. No.: 384,108

[22] Filed: Feb. 3, 1995

[51] Int. Cl.[6] ..... H04R 25/02

[52] U.S. Cl. ..... 181/130; 181/135; 381/68.6; 381/69

[58] Field of Search ..... 181/130, 135; 381/68.6, 69

[56] References Cited

U.S. PATENT DOCUMENTS 1,953,437 4/1934 Schier ..... 181/135

2,312,534 3/1943 Fiene ..... 181/135

4,878,560 11/1989 Scott ..... 181/135

*Primary Examiner*—Khanh Dang

*Attorney, Agent, or Firm*—Lloyd W. Sadler; Daniel P. McCarthy

[57] ABSTRACT

Earmolds for holding communications devices within the ear in a secure and comfortable manner. The earmolds are designed to minimize protrusion into the ear canal, while providing security by extending the helix of the earmold to fit under the crux of the ear's helix. These earmolds are also designed to avoid a seal in the ear canal, thereby reducing discomfort, improving wearer's ability to localize sounds. These earmolds are designed to fit the majority of people with the minimum number of required sizes. With this design, communications devices can be worn within the ear in a comfortable, safe, secure manner.

19 Claims, 3 Drawing Sheets

EARMOLDS FOR TWO-WAY COMMUNICATIONS DEVICES

BACKGROUND OF THE INVENTION

A. Field of the Invention

The invented earmolds are related to the field of devices used in conjunction with two-way communications wherein the device resides at the opening of the user's ear. This invention is particularly useful because of its unique shape configuration, which provides for improved fit, comfort and hygiene while maintaining high quality sound transmission. This invention is intended to be used in combination with and as an enclosure for both a microphone and a speaker in a two-way communications system. This invention is formed in the general shape of the ear's concha and is produced in a variety of sizes and colors.

B. Description of Related Art

Various types of earmolds are manufactured in the prior art, primarily for use in hearing aids. Existing earmolds rely on a deep and tight insertion into the ear canal for providing stability of the hearing aid in the ear. This type of deep and tight insertion tends to cause painful rubbing of the insert against the ear canal and also can have the effect of sealing the ear canal. As a result, the user experiences irritation and discomfort, particularly after many consecutive hours and days of use. Sealing the ear canal has dangerous implications to the wearer. It will affect a person's ability to hear ambient sound by reducing the intensity of the sound. It will alter a person's ability to localize sound, particularly in the high frequencies where interaural sound pressure differences are the primary cue for localization.

SUMMARY OF THE INVENTION

It is an object of this invention to provide an earmold device to hold a two-way communications device in the ear. The invented earmold accomodates both a speaker and a microphone and provides high quality sound transmission.

It is an object of this invention to provide an earmold device which holds a two-way communications device at the ear opening in a secure manner. The invented earmold, although not deeply penetrating the ear canal deeply, is securely fastened at the ear opening by use of an extended helix.

It is an object of this invention to provide an earmold device which holds a two-way communications device in the ear in a comfortable manner. By securing the earmold outside of the ear canal rather than in the ear canal and by avoiding deep penetration of the ear canal, user comfort is greatly enhanced.

It is an object of this invention to provide an earmold device, which holds a two-way communications device in the ear, which provides for reduced feedback by providing improved isolation between the microphone and the speaker. The preferred structure of the earmold accomodates this design.

It is an object of this invention to provide an earmold device, which holds a two-way communications device in the ear, which greatly reduces the risk of electrostatic discharge. The isolation of electrical components from the skin of the wearer that is provided by the invented earmold reduces this risk.

It is an object of this invention to provide an earmold device, which holds a two-way communications device in the ear, which provides a low pass filter to the speaker response. The preferred speaker arrangement provides the desired low pass filter.

The invented earmold gains a stable mounting at the ear opening by using an extended helix of the earmold to cause the earmold to fit under the crus of the helix of the ear. This newly invented configuration, therefore, requires a much shallower insertion into the ear canal, thereby not sealing the ear canal.

Another difference between the invention and the prior art is that the invented earmold utilizes a design specifically for use with two-way communications devices. The earmold is designed to house both a speaker and a microphone and to receive and transmit sound in a high quality manner to achieve useful two-way communication.

Another feature of the invented earmold that is not found in the prior art is that the invented earmold's profile follows the curvature of the ear canal. By following the curvature of the ear canal, the user's comfort is greatly improved.

A further difference between the earmold of the present invention and the prior art is the use of a notch in the earmold. The notch provides relief to the antitragus. Relief to the antitragus is important to prevent compression of tissue at the antitragus and to avoid associated discomfort.

Additionally, when the invented earmold is used, no occlusion of the ear canal occurs. By avoiding occlusion of the ear canal, a person's ability to hear ambient sound is not diminished and a person's ability to localize sound is maintained. Occlusion is prevented in the invention by utilization of a vent in the earmold.

The invented earmold also includes markings on its surface for reference by the wearer to ensure proper orientation of the two-way communication device.

Some of the advantages of the invention over the prior art include: (1) a decrease in the depth of insertion of the device into the ear; (2) increased comfort, since the weight is supported outside rather than inside the ear canal; (3) improved hygiene because of limited insertion; (4) greatly reduced possibility of causing a seal within the ear canal; (5) a decrease in the number of sizes and shapes of earmolds necessary to fit the majority of the population; and (6) specific design features to accommodate use by the general population that does not have a hearing impairment as a component in a two-way communication device.

DETAILED DESCRIPTION OF THE INVENTION

This invention is an earmold for use in holding a two-way communications device at the opening of a user's ear. The preferred embodiment of the invention comprises a form in the shape of the ear's concha, sized to fit within the outer ear and composed of a soft plastic material. However, this same invention can be made from a variety of other flexible materials including, but not limited to polyvinyl and silicone.

The invented earmold is soft, yieldable and free of rough or sharp edges. It is designed to fit comfortably inside the outer ear. The mold includes a cavity in the outside (first) side for holding an audio communication device. The mold also has incorporated on its first side an alignment mark which is used to indicate to the user the proper orientation of the communications device.

In the preferred embodiment, the audio communications device includes both a microphone and a speaker. The mold also includes two protrusions on the inside (second) side. The first protrusion is for the purpose of holding the earmold in place. This is done by inserting the mold into the ear and then rotating the mold so that this first protrusion rests under the crus of the helix of the ear. The second protrusion is for the purpose of providing a means for sound to be conveyed from the speaker into the user's ear canal. This second protrusion is designed to require only a very shallow insertion (approximately 4 mm) into the user's ear canal. This second protrusion also has incorporated into it an ear canal insert vent to prevent a pneumatic seal from being formed in the ear.

Figure 1A:
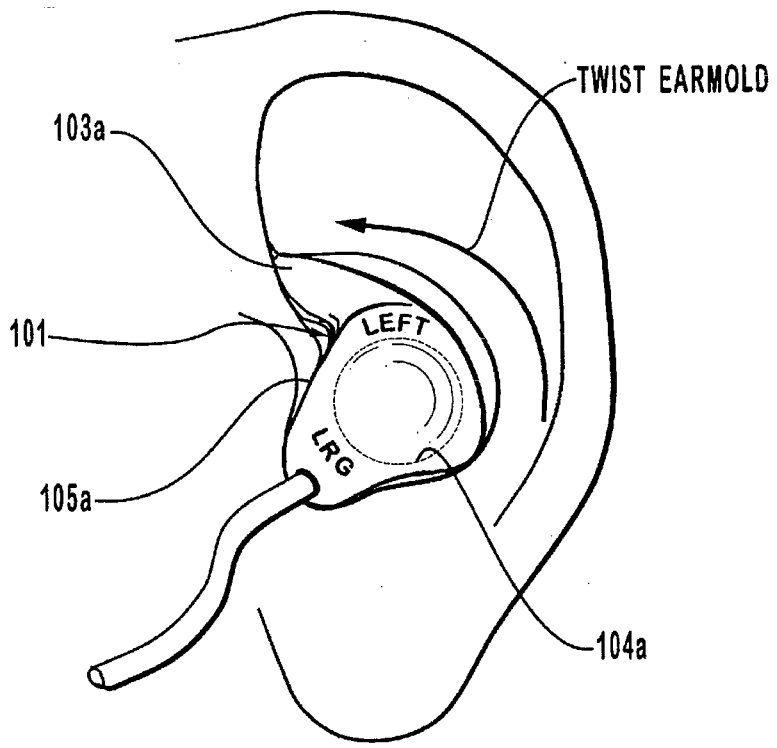
FIG. 1*a* depicts one preferred embodiment of a left earmold of the present invention installed in a human ear.

FIG. 1*a* shows one preferred embodiment of a left earmold 101 inserted at the opening of a human ear. It can be seen from the figure that the earmold 101 is held in place in the ear, at least in part, by a protrusion or helix 103*a*. It can also be seen that the earmold has a receptacle 104*a* to accommodate an earphone containing a speaker, microphone and circuitry. The earmold also has a vent or notch 105*a* to the ear canal to prevent a pneumatic seal from forming in the ear canal. The vent 105*a* also accomodates the transmission of sound into the ear canal from the user's surroundings.

Figure 1B:
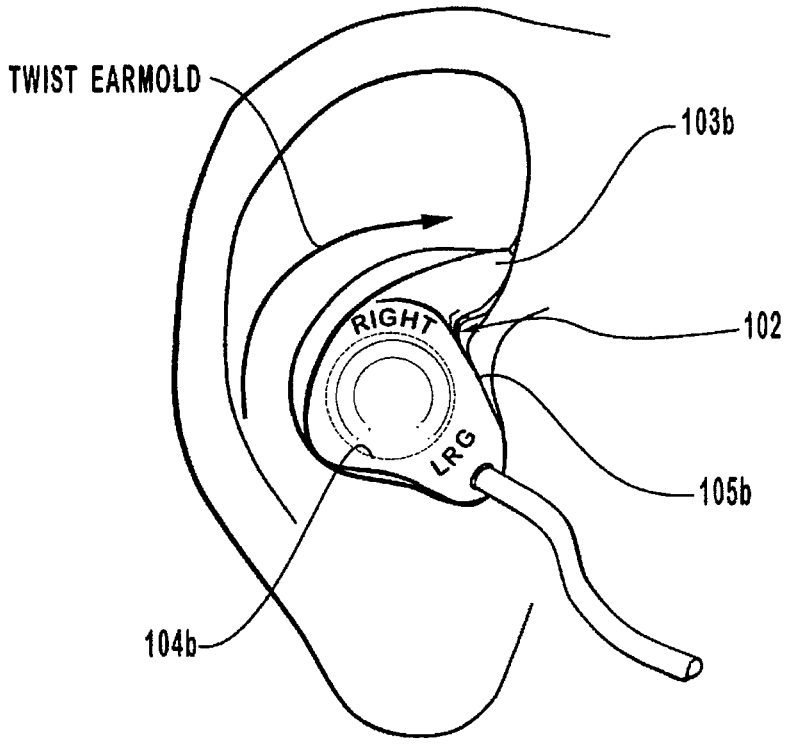
FIG. 1*b* depicts one preferred embodiment of a left earmold of the present invention installed in a human ear.

FIG. 1*b* shows a preferred right earmold 102 inserted at the opening of a human ear and generally corresponding to the left earmold 101 of FIG. 1*a*. The right earmold 102 has a protrusion or helix 103*b* for holding the earmold in the ear, a receptacle 104*b* to accommodate an earphone containing a speaker, microphone and circuitry, and a vent or notch 105*a* to the ear canal to prevent a pneumatic seal from forming in the ear canal and to accommodate the transmission of sound into the ear canal from the user's surroundings. It can be seen from FIGS. 1*a* and 1*b* that the shape and size of the earmold is selected to match and fit within the user's outer ear.

Figure 2A:
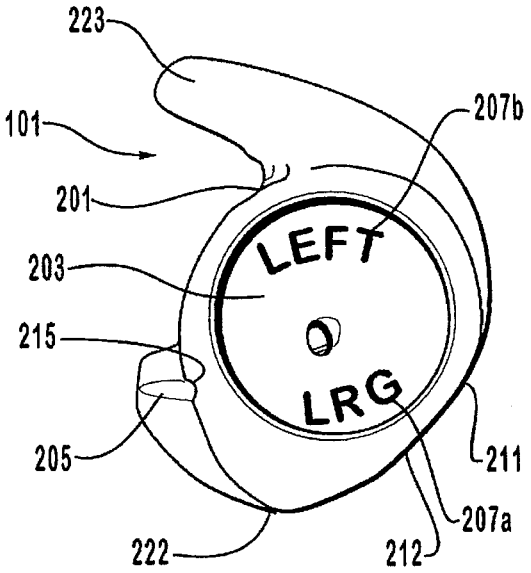
FIG. 2*a* depicts one preferred embodiment of a left earmold of the present invention.

FIG. 2*a* shows the first side 201 of the left earmold 101. The bottom 211 of the left earmold 101 and the antitragus notch 212 are shown. A cavity or receptacle 203 is provided to accommodate an earphone with a speaker, microphone and relevant circuitry. The receptacle 203 is located on the approximate center of the first side 201 of the earmold 101, the second side of the earmold being defined as the side of the earmold adjacent to the user's ear. In the preferred embodiment of the invention, the cavity 203 is dome-shaped, with the shallowest part of the cavity being 0.160 inches deep at the outer edge and the crest of the dome extending another 0.070 inches in the center of the cavity 203. The preferred cavity 203 is circular in shape and approximately 0.5 inches in diameter.

An alignment marks 205 is shown extending downward and toward the front of the ear, when installed. The purpose of the alignment mark 205 is to indicate to the user the proper orientation of the audio communication device in the earmold. In the preferred embodiment, the mark 205 is located by a raised rib on the bottom of the first side of the earmold. The preferred rib is 0.060 inches in width and 0.015 inches in height.

In the figure, the notch 215 which is gas-communicative with the ear canal is shown. The notch prevents a pneumatic seal from being formed in with the ear canal.

Labeling 207*a* and 207*b* is included on the first side 201 of the earmold 101 to indicate the size of the mold (large) and the intended ear (left ear) respectively.

Also shown is the lower lobe 222 and helix 223. The earmold is kept in place in the ear by the combination of the helix and features found on the second side of the earmold, with the assistance of contact, even if slight, by the lower lobe, bottom, and antitragus notch.

Figure 2B:
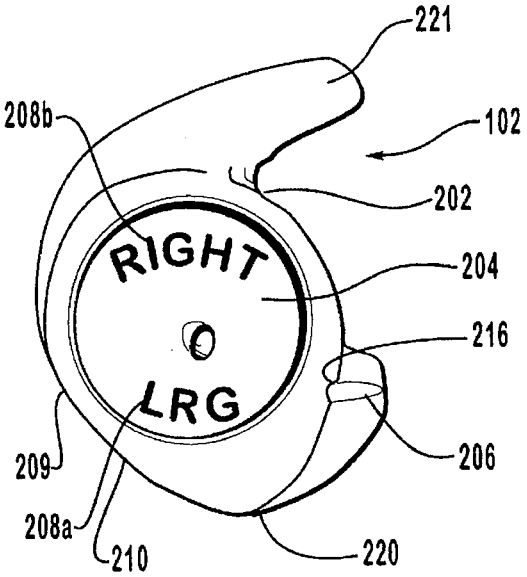
FIG. 2*b* depicts one preferred embodiment of a right earmold of the present invention.

The description of FIG. 2*b* parallels that of FIG. 2*a*, but for a right earmold. FIG. 2*b* shows the first side 202 of the right earmold 102. The bottom 209 of the right earmold 102 and the antitragus notch 210 are shown. A cavity or receptacle 204 is provided to accommodate an earphone with a speaker, microphone and relevant circuitry. The receptacle 204 is located on the approximate center of the first side 202 of the earmold 102, the second side of the earmold being defined as the side of the earmold adjacent to the user's ear. In the preferred embodiment of the invention, the cavity 204 is dome-shaped, with the shallowest part of the cavity being 0.160 inches deep at the outer edge and the crest of the dome extending another 0.070 inches in the center of the cavity 204. The preferred cavity 203 is circular in shape and approximately 0.5 inches in diameter.

An alignment mark 206 is shown extending downward and toward the front of the ear, when installed. The purpose of the alignment mark 206 is to indicate to the user the proper orientation of the audio communication device in the earmold. In the preferred embodiment, the mark 206 is located by a raised rib on the bottom of the first side of the earmold. The preferred rib is 0.060 inches in width and 0.015 inches in height.

In the figure, the notch 216 which is gas-communicative with the ear canal is shown. The notch prevents a pneumatic seal from being formed in with the ear canal.

Also shown is the lower lobe 220 and helix 221. The earmold is kept in place in the ear by the combination of the helix and features found on the second side of the earmold, with the assistance of contact, even if slight, by the lower lobe, bottom, and antitragus notch.

Labeling 208*a* and 208*b* is included on the first side 201 of the earmold 101 to indicate the size of the mold (large) and the intended ear (right ear) respectively.

Figure 3:
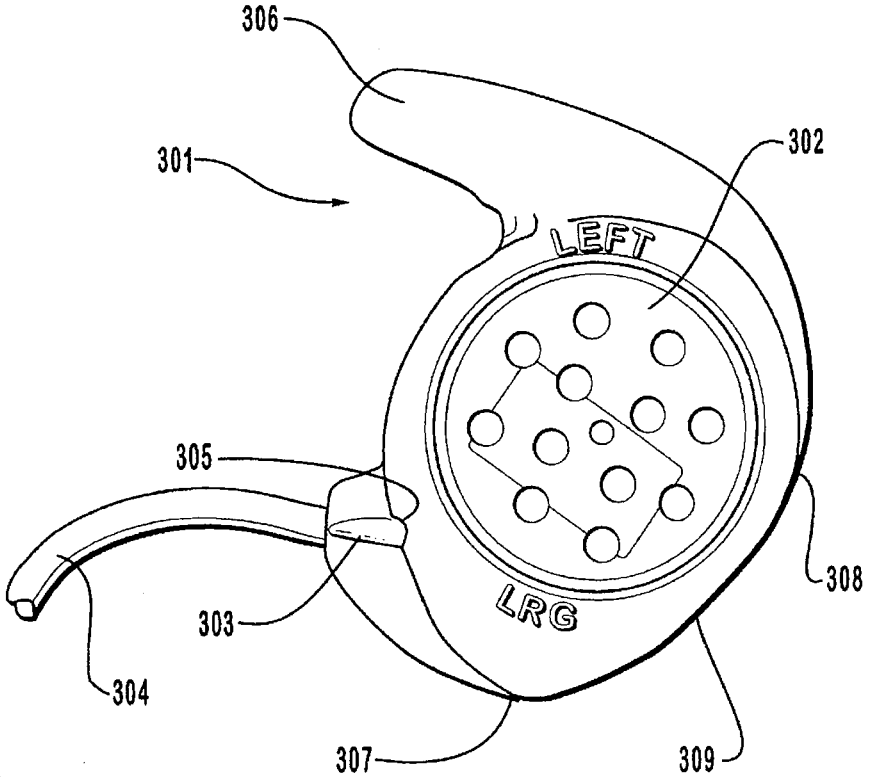
FIG. 3 depicts one preferred embodiment of a left earmold with an earphone installed therein.

FIG. 3 shows the left earmold 301 with an audio communications device 302 installed. In this instance, the audio communications device is a device available from JABRA Corporation of San Diego, Calif. which is marketed under the trademark Ear PHONE™. Also apparent from FIG. 3 is the size of the particular earphone. The alignment mark 303 is depicted and the power cord 304 for the earphone is shown. The notch 305 to the ear canal, the helix 306, the lower lobe 307, the bottom 308, and the antitragus notch 309 are shown.

Figure 4A:
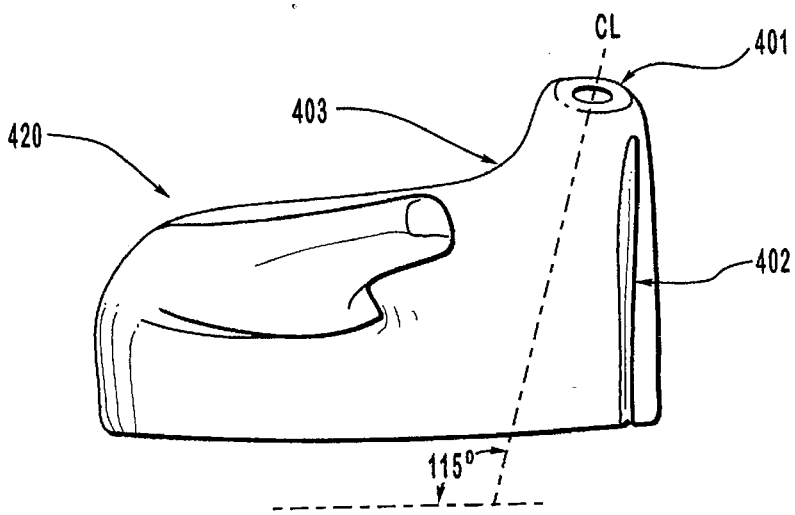
FIG. 4*a* depicts a side view of one preferred embodiment of the invented earmold.

FIG. 4*a* show a side of one preferred earmold. The second protrusion 401 is extending upward from the base of the second side 420 of the earmold at an angle of approximately 115 degrees from the horizontal to most closely match the curvature of the user's ear canal. The insertion depth of the second protrusion 401 is kept to 6.0 mm or less, in the preferred embodiment, for the purpose of minimizing physical contact with the inner ear canal. The ear canal insert vent 402 is provided to prevent a pneumatic forming seal in the ear. In the preferred embodiment, this vent 402 is 0.090 inches wide and 0.045 inches deep with curved edges inside and outside the vent. The vent 402 extends from the first side of the mold up the side of the second protrusion 401, ending no less than 0.10 inches from the end of the second protrusion 401. The second protrusion 401 is angled back 403 or curved by an amount approximating the concha angle of the a user's ear. The purpose of this angle 403 is to permit a closer, more comfortable fit with the ear.

Figure 4B:
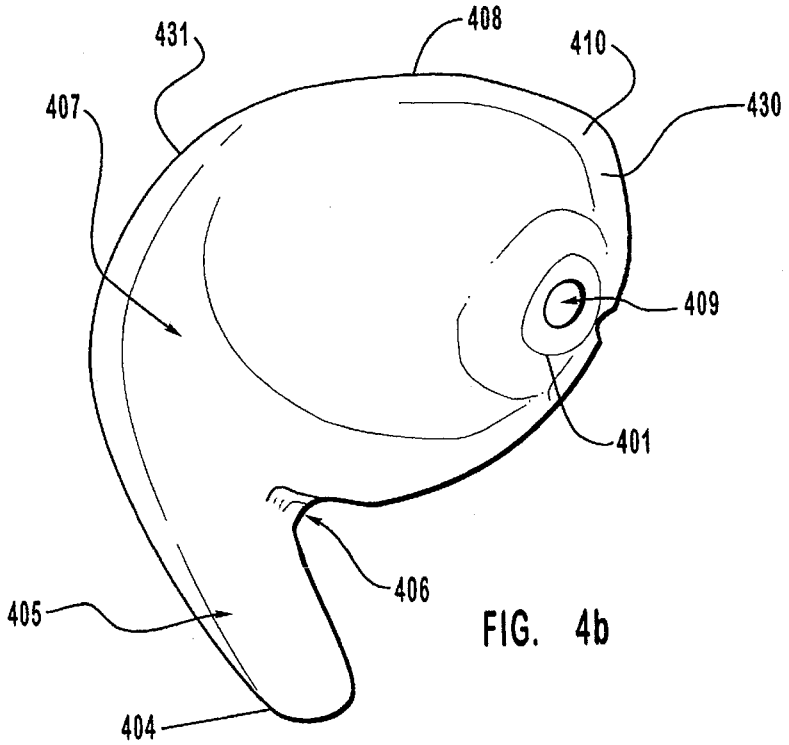
FIG. 4*b* depicts a top view of one preferred embodiment of the invented earmold.

Referring to FIG. 4*b*, a side view of the preferred earmold is shown. The first protrusion (helix) 404 is shown in the top view of FIG. 4. The first protrusion 404 is designed to fit comfortably under the crux of helix of the outer ear. A valley 406 exists between the first protrusion 404 and the second protrusion 401. The purpose of this valley 406 is to more naturally fit the contours of the outer ear and achieve user comfort. Also, a concha dehump 407 is also included in the lower center of the second side to permit a close fit with the outer ear. A sound bore 409 is provided, extending from one edge of the cavity 203, 204 in the first side to the tip of the second protrusion 401. This bore 409 is used to provide a means for the sound to travel from the speaker part of the audio communications device to the ear canal of the user, and is by nature, gas communicative between the cavity 203 and the wearer's ear canal. In the preferred embodiment, this bore 409 is 0.10 inches in diameter and is as close as possible to the center of the second protrusion 401 while still allowing for the vent 402. The center of the bore 409 is 0.090+/−0.030 inches from the edge of the audio communications device cavity 203, 204. An antitragus notch 408 is included in the design of the earmold to provide for a better fit with the user's ear. A shoulder 410 is also provided in the region of the lower lobe 430 for a better fit with the user's ear. Also depicted is the bottom 431.

Figure 4C:
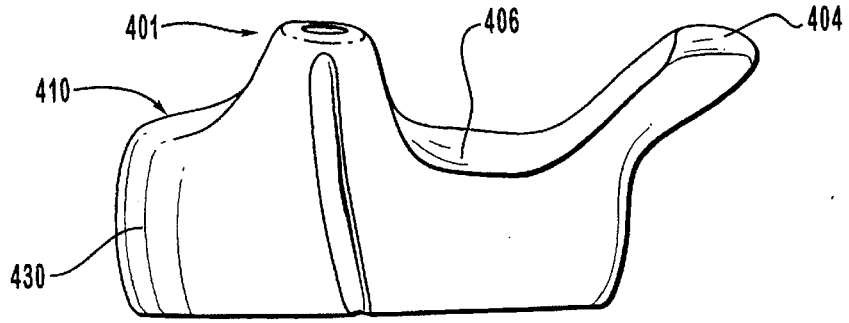
FIG. 4*c* depicts a top view of one preferred embodiment of the invented earmold.

In FIG. 4*c*, a front view of the preferred earmold is depicted. Shown is the first protrusion 401, valley 406, helix 404, shoulder 410, and lower lobe 430.

In an alternative embodiment of the invention, the earmold may omit the receptacle for an earphone, the receptacle for an earphone being considered a mounting apparatus for a communications device, and instead use an alternative mounting apparatus for a communications device. For example, the earmold could have a ring on its first side to which a communications device snaps. Other alternatives are possible as well.

In another alternative embodiment of the invention, the earmold does not include the second protrusion which penetrates (although not deeply) the ear canal. The second protrusion can be omitted and secure mounting to an ear can still be achieved. A sound bore would still be desired.

While the present invention has been described and illustrated in conjunction with a preferred embodiment, those skilled in the art will appreciate that variations and modifications may be made without departing from the principles of the invention as herein, illustrated described and claimed.

The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes which come within the meaning and range of equivalence of the claims are to be embraced within their scope.

We claim:

1. An earmold device, suitable for wearing at the user's outer ear, the ear having a helix, a crus, and an antitragus, said earmold device adapted for holding a communications device for use in two-way communications systems, said earmold device comprising:

(a) a mold shaped to fit within the user's outer ear, said mold having a first side, a first bend, a bottom portion, a second bend, and a second side;

said bottom portion connected by said first bend in said mold to said first side, and said second side connected by said second bend in said mold to said bottom portion;

(b) a cavity in said first side, said cavity being adapted to receive the communications device inserted therein;

(c) a first protrusion extending from said second side for maintaining said mold in place within the user's ear, said maintaining of said mold in place within the user's ear being accomplished by positioning said first protrusion within the user's outer ear and under the crus of the helix of the user's outer ear;

(d) a second protrusion having an attached end and an unattached end, said attached end of said second protrusion connected to said second side of said mold, and said unattached end adapted for insertion in the entrance of the user's ear canal;

wherein said device comprises a flexible material; and wherein said second protrusion is about the same size as the user's ear canal such that said second protrusion does not sealingly engage the ear canal.

2. An earmold device, suitable for wearing within the user's outer ear, the ear having a helix, a crus, and an antitragus, said earmold device adapted for holding a communications device for use in two-way communications systems, said earmold device as recited in claim 1, further comprising:

an alignment mark placed on said first side and below said first protrusion, for positioning of the communications device within said cavity in said first side of said mold.

3. An earmold device, suitable for wearing within the user's outer ear, the ear having a helix, a crus, and an antitragus, said earmold device adapted for holding a communications device for use in two-way communications systems, said earmold device as recited in claim 1, wherein said mold is composed of a plastic material and wherein said mold has only smooth curved surfaces on said second side to enhance the user's comfort.

4. An earmold device, suitable for wearing within the user's outer ear, the ear having a helix, a crus, and a antitragus, said earmold device adapted for holding a communications device for use in two-way communications systems, said earmold device as recited in claim 1, further comprising:

(f) a notch located in said bottom portion of said mold to provide contact relief to the user's antitragus.

5. An earmold device, suitable for wearing within the user's outer ear, the ear having a helix, a crus, and an antitragus, said earmold device adapted for holding a communications device for use in two-way communications systems, said earmold device as recited in claim 3, further comprising:

(d) a second protrusion having an attached end and an unattached end, said attached end of said second protrusion connected to said second side of said mold, and said unattached end adapted for insertion in the entrance of the user's ear canal;

wherein said second protrusion further comprises an ear canal vent extending from said unattached end of said second protrusion on said second side to said first side, said vent being an aperture for which air pressure is equalized between user's inner ear and user's outer ear.

6. An earmold device, suitable for wearing within the user's outer ear, the ear having a helix, a crus, and an antitragus, said earmold device adapted for holding a communications device for use in two-way communications systems, said earmold device as recited in claim 3, further comprising:

(d) a second protrusion having an attached end and an unattached end, said attached end of said second protrusion connected to said second side of said mold, and said unattached end adapted for insertion in the entrance of the user's ear canal; and (e) a sound bore, said sound bore have a first exit and a second exit, said first exit of said sound bore being coincident with said unattached end of said second protrusion; said second exit of said sound bore being on said interior of said cavity; said sound bore providing a venue for sound to travel from said cavity to the user's ear canal; and said sound bore being an aperture for which air may flow between said first side and said second side.

7. An earmold device, suitable for wearing within the user's outer ear, the ear having a helix, a crus, and an antitragus, said earmold device adapted for holding a communications device for use in two-way communications systems, said earmold device as recited in claim 3, further comprising:

(d) a second protrusion having an attached end and an unattached end, said attached end of said second protrusion connected to said second side of said mold, and said unattached end adapted for insertion in the entrance of the user's ear canal;

wherein said second protrusion further comprises:

(e) an exterior surface; and (f) an ear canal vent running along said exterior surface of said second protrusion for preventing a pneumatic seal from forming in the user's ear.

8. An earmold device, suitable for wearing within the user's outer ear, the ear having a helix, a crus, and an antitragus, said earmold device adapted for holding a communications device for use in two-way communications systems, said earmold device as recited in claim 3, further comprising:

(d) a second protrusion having an attached end and an unattached end, said attached end of said second protrusion connected to said second side of said mold, and said unattached end adapted for insertion in the entrance of the user's ear canal;

wherein said second protrusion has a measurement of 6.0 mm or less in length from said attached end to said unattached end.

9. An earmold device, suitable for wearing within the user's outer ear, the ear having a helix, a crus, and a antitragus, said earmold device adapted for holding a communications device for use in two-way communications systems, said earmold device as recited in claim 1, further comprising:

(j) a sound bore, said sound bore have a first exit and a second exit, said first exit of said sound bore being coincident with said unattached end of said second protrusion; said second exit of said sound bore being on said interior of said cavity; said sound bore providing a venue for sound to travel from said cavity to the user's ear canal; and said sound bore being an aperture for which air may flow between said first side and said second side.

10. An earmold device, suitable for wearing within the user's outer ear, the ear having a helix, a crus, and a antitragus, said earmold device adapted for holding a communications device for use in two-way communications systems, said earmold device comprising:

(a) a mold shaped to fit within the user's outer ear, said mold having a first side, a first bend, a bottom portion, a second bend, and a second side; said bottom portion connected by said first bend in said mold to said first side, and said second side connected by said second bend in said mold to said bottom portion;

(b) a mounting apparatus located on said first side of said mold, said mounting apparatus being generally circular in shape and having a ridge adapted to mount the communications device thereto, and said mounting apparatus being capable of holding the communications device;

(c) a first protrusion extending from said second side for maintaining said mold in place within the user's ear, said maintaining of said mold in place within the user's ear being accomplished by positioning said first protrusion within the user's outer ear and under the crus of the helix of the user's outer ear;

(d) a second protrusion having an attached end and an unattached end, said attached end of said second protrusion connected to said second side of said mold, and said unattached end adapted for insertion in the entrance of the user's ear canal;

wherein said device comprises a flexible material; and wherein said second protrusion is about the same size as the user's ear canal such that said second protrusion does not sealingly engage the ear canal.

11. An earmold device, suitable for wearing within the user's outer ear, the ear having a helix, a crus, and a antitragus, said earmold device adapted for holding a communications device for use in two-way communications systems, said earmold device as recited in claim 10, further comprising:

(e) an alignment mark placed on said first side and below said first protrusion, for positioning of the communications device within said cavity in said first side of said mold.

12. An earmold device, suitable for wearing within the user's outer ear, the ear having a helix, a crus, and a antitragus, said earmold device adapted for holding a communications device for use in two-way communications systems, said earmold device as recited in claim 10 wherein said mold is soft and flexible.

13. An earmold device, suitable for wearing within the user's outer ear, the ear having a helix, a crus, and a antitragus, said earmold device adapted for holding a communications device for use in two-way communications systems, said earmold device as recited in claim 10, further comprising a notch located in said bottom portion of said mold to provide contact relief to the user's antitragus.

14. An earmold device, suitable for wearing within the user's outer ear, the ear having a helix, a crus, and an antitragus, said earmold device adapted for holding a communications device for use in two-way communications systems, said earmold device as recited in claim 10 further comprising:

(d) a second protrusion having an attached end and an unattached end, said attached end of said second protrusion connected to said second side of said mold, and said unattached end adapted for insertion in the entrance of the user's ear canal;

wherein said second protrusion further comprises an ear canal vent extending from said unattached end of said second protrusion on said second side to said first side.

15. An earmold device, suitable for wearing within the user's outer ear, the ear having a helix, a crus, and an antitragus, said earmold device adapted for holding a communications device for use in two-way communications systems, said earmold device as recited in claim 10, further comprising:

(d) a sound bore that extends from said mounting apparatus located on said first side of said mold through said second protrusion for providing a channel for sound to travel from said mounting apparatus to user's ear canal.

16. An earmold device, suitable for wearing within the user's outer ear, the ear having a helix, a crus, and an antitragus, said earmold device adapted for holding a communications device for use in two-way communications systems, said earmold device as recited in claim 10, further comprising:

(d) a second protrusion having an attached end and an unattached end, said attached end of said second protrusion connected to said second side of said mold, and said unattached end adapted for insertion in the entrance of the user's ear canal;

wherein said second protrusion further comprises an exterior surface and an ear canal vent running along said exterior surface of said second protrusion for preventing a pneumatic seal in the user's ear.

17. An earmold device, suitable for wearing within the user's outer ear, the ear having a helix, a crus, and an antitragus, said earmold device adapted for holding a communications device for use in two-way communications systems, said earmold device as recited in claim 10, further comprising:

(d) a second protrusion having an attached end and an unattached end, said attached end of said second protrusion connected to said second side of said mold, and said unattached end adapted for insertion in the entrance of the user's ear canal;

wherein said second protrusion has a measurement of 6.0 mm or less in length from said attached end to said unattached end.

18. An earmold device, suitable for wearing within the user's outer ear, the ear having a helix, a crus, and a antitragus, said earmold device adapted for holding a communications device for use in two-way communications systems, said earmold device as recited in claim 10, further comprising:

(f) a sound bore that extends from the vicinity of said mounting apparatus on said first side through said mold to said second side, said sound bore providing a venue for sound to travel from said mounting apparatus to the user's ear canal, and said sound bore providing a channel for the passage of air from said first side to said second side.

19. An earmold device, suitable for wearing within the user's outer ear, the ear having a helix, a crus, and an antitragus, said earmold device adapted for holding a communications device for use in two-way communications systems, said earmold device as recited in claim 10, further comprising:

(d) a second protrusion having an attached end and an unattached end, said attached end of said second protrusion connected to said second side of said mold, and said unattached end adapted for insertion in the entrance of the user's ear canal; and (e) an ear canal vent located on said mold, said ear canal vent providing a channel for the passage of air from said second side to said first side, and said ear canal vent being adapted to avoid the formation of a pneumatic seal in the user's ear.

* * * * *